US005687953A

United States Patent [19]

Huppert

[11] Patent Number: 5,687,953

[45] Date of Patent: Nov. 18, 1997

[54] JACK APPARATUS

[75] Inventor: Anthony R. Huppert, Baldwin, Wis.

[73] Assignee: Team Oil Inc., Spring Valley, Wis.

[21] Appl. No.: 692,956

[22] Filed: Aug. 7, 1996

[51] Int. Cl.[6] ..... B66F 3/36

[52] U.S. Cl. ..... 254/133 R; 254/103; 254/100

[58] Field of Search ..... 29/273; 254/133, 254/134, 98, 100, 103, 8 B, 7 B, 7 R, DIG. 1, DIG. 2, DIG. 3, 1, 133 R

[56] References Cited

U.S. PATENT DOCUMENTS

| | | | |
|---|---|---|---|
| 2,962,730 | 12/1960 | Carnes et al. | 254/7 R |
| 3,120,945 | 2/1964 | Schultz et al. | 254/134 |
| 4,483,515 | 11/1984 | Maryonovich | 254/103 |

*Primary Examiner*—Timothy V. Eley
*Assistant Examiner*—Lee Wilson
*Attorney, Agent, or Firm*—Clayton R. Johnson

[57] ABSTRACT

The jack apparatus includes a jack having a tubular housing that is elevated by jack screw mechanism. Arm members are mounted to the tubular housing to extend transversely outwardly in opposite directions for mounting a chain to permit adjustably varying the length of chain end portions extending away from the arm members that are to be attached to the object to be elevated. A tire is mounted to the tubular housing for abutting against the object that is to be elevated, the tire extending vertically above and below the arm members, and transversely further outwardly of the tubular housing than the tire. The tire has a vertical annular surface for abutting against the object.

13 Claims, 3 Drawing Sheets

JACK APPARATUS

BACKGROUND OF THE INVENTION

This invention relates to jack apparatus usable for lifting various objects, for example, storage tanks, vehicles and posts in the ground, and more particularly to jack apparatus having mechanism mounted to a jack housing to in part frictionally engage the object to be lifted.

U.S. Pat. No. 4,629,163 to Miller et al. discloses a jack having a tank support mounted to a vertical jack channel to extend downwardly and away from the jack channel, and chains mounted in keyhole slots in a horizontal plate that is mounted the lower end of the tank support. Each of U.S. Pat. No. 3,850,409 to Davis et al. and No. 3,892,385 to Andrist et al. discloses jack apparatus that includes a pair of chains utilizable in repairing automobiles.

In order to make improvements in jack apparatus, this invention has been made.

SUMMARY OF THE INVENTION

The jack apparatus includes a tubular housing vertically movable relative to a support member with arm members extending outwardly from the tubular housing. The arm members have slotted portions for mounting selective lengths of chains which have opposite ends to retain the chains in attached relationship to the object to be lifted. A rubber tire is mounted to the tubular housing front wall to be horizontally forward of the arm members to extend horizontally more remote of the tubular housing than the arm members and a substantial distance above and below the arm members for frictionally engaging the object to be lifted to aid in avoiding slippage of the object being elevated with the chains and damage to the object. The tire is mounted to a rim assembly to extend further horizontally away from the arm members and the tubular housing than the rim assembly, the rim assembly being mounted to the tubular housing.

One of the objects of this invention is to provide new and novel jack means for lifting various objects, including posts that have their lower ends mounted in the ground. Another object of this invention is to provide new and novel means mounted to a vertically movable member of a jack for attachment to the object to be lifted together with frictionally engaging the object to facilitate lifting various objects.

DESCRIPTION OF THE PREFERRED EMBODIMENT

Figure 5:
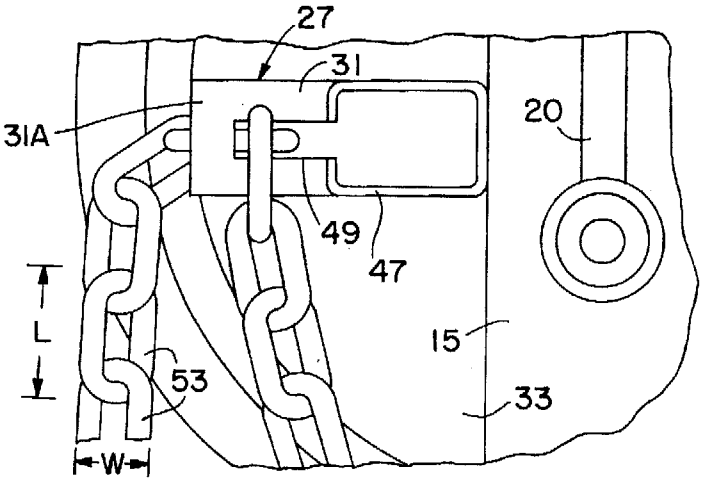
FIG. 5 is an enlarged fragmentary view of a rear portion of the apparatus of FIG. 2.
Figure 1:
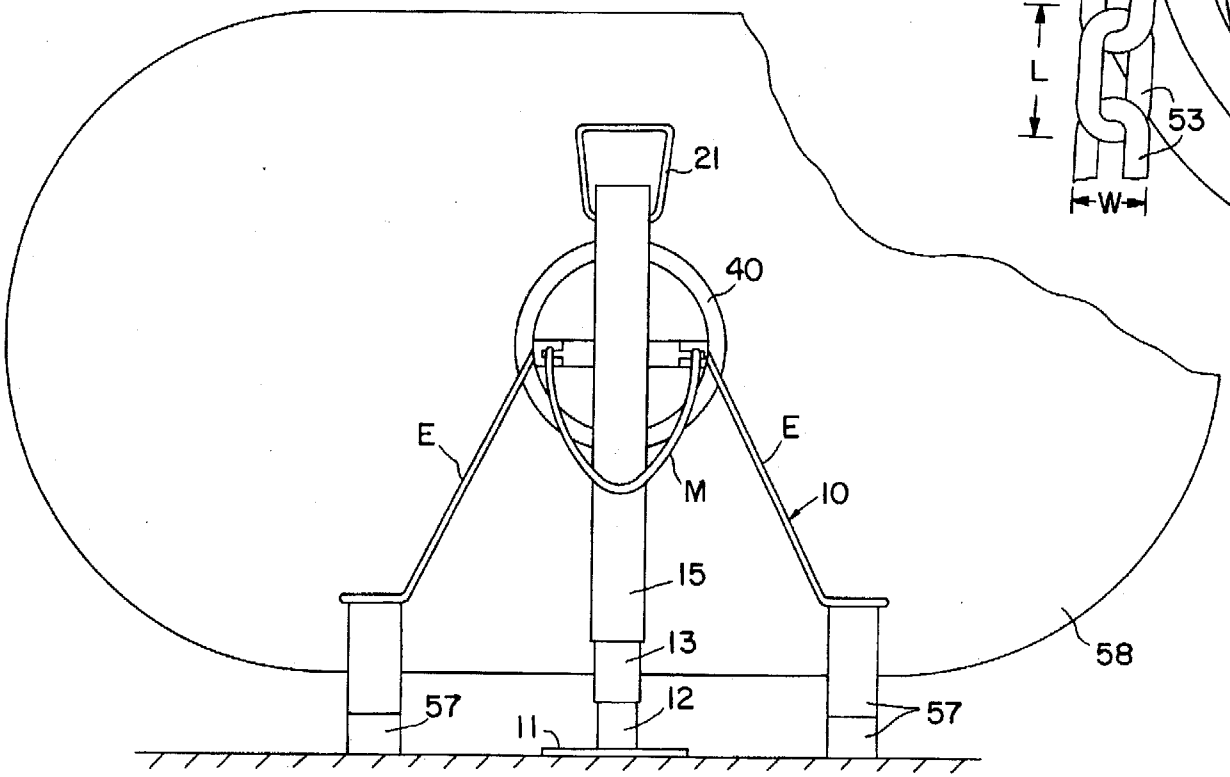
FIG. 1 is a somewhat schematic rear view of the jack apparatus of this invention with the jack apparatus lifting one side of a tank and portion of the tank broken away.

Referring now to the drawings, the jack apparatus of this invention, generally designated 10, may include a conventional jack having a vertical support member 12 mounted to the base 11 to extend thereabove, the support member being either tubular or solid in horizontal transverse cross section. The support member 12 telescopically extends into a vertically elongated tubular member 13 for being retained in selected vertically adjusted positions relative to the support member by a pin 14 extended through apertures (not shown) in the tubular member that are vertically aligned with aperture(s) 25 in the support member 12, there being a plurality of vertically spaced, horizontal apertures 25 in the support member. The tubular member 13 telescopically extends into the tubular housing 15 for vertical slidable movement relative thereto. A tubular housing closure 22 is mounted to the upper end portion of the tubular housing 15. Advantageously, each of the support member, the tubular member and the tubular housing are generally rectangular in horizontal cross section and them form a close sliding fit with one another.

The upper end portion of the tubular housing mounts a screw nut 23 in a fixed vertical relationship relative thereto, the screw nut mounting a jack screw 24 for vertical movement relative thereto as the jack screw is rotated. A conventional thrust bearing assembly 17 is mounted to the upper end of the jack screw and the tubular housing for vertically moving the tubular housing relative to the tubular member 13 as the jack screw is rotated. A crank 20 is mounted for rotation by the upper end of the tubular housing, there being beveled gears 18, 19 mounted to the crank and jack screw respectively to rotate the jack screw as the crank is rotated and thereby vertically move the tubular housing relative to members 12, 13. A handle 21 is mounted to the upper end portion of the tubular housing to facilitate moving the jack.

Arm members, generally designated 27 and 28 respectively are mounted to opposite upper portions 15B of the side walls of the tubular housing to extend transversely outwardly therefrom in opposite directions. The arm members 27, 28 include mounting flanges 29, 30 and tubular chain mounts 31, 32 respectively, the mounting flanges being mounted to the tubular housing while the chain mounts are mounted to the mounting flanges. Mounted to front wall 15A of the tubular housing and to the mounting flanges is a tire mount, generally designated 34, which includes a circular plate 33 that advantageously is vertically and horizontally centered relative to the arm members. Mounted to the plate 33 is a hub that includes a disk 38 mounted to the plate 33 and a circular cylindrical rim 39 mounted to the disk to extend horizontally forwardly of the tubular housing. The central axis X-X of the rim extends perpendicular to the axis of rotation C-C of the jack screw and the central vertical axis C-C of elongation of the tubular member. Mounted to the rim is an annular resilient member 40 which advantageously is a rubber tire.

The axial dimension of the tire 40 is substantially greater than the corresponding axial dimension of the rim whereby the plane of the annular surface 40A of the tire furthest axially remote from the front wall 15A of the tubular housing. Thus, the plane of the surface 40A is substantially further remote from the tubular housing than the plane of the peripheral surface of the rim which is furthest axially remote from the tubular housing. Also, the plane of the surface 40A is vertical when the central axis of the jack screw and the axis of elongation of the tubular housing is vertical and is parallel to said axes. Additionally, the vertical surface 40A has vertically opposite portions that are adapted for abutting against the object to be lifted at substantial distances above and below the arm members and horizontally, transversely opposite portions on transverse opposite sides of the tubular housing transversely more remote from the tubular housing than the transversely most remote parts of the arm members.

Figure 2:
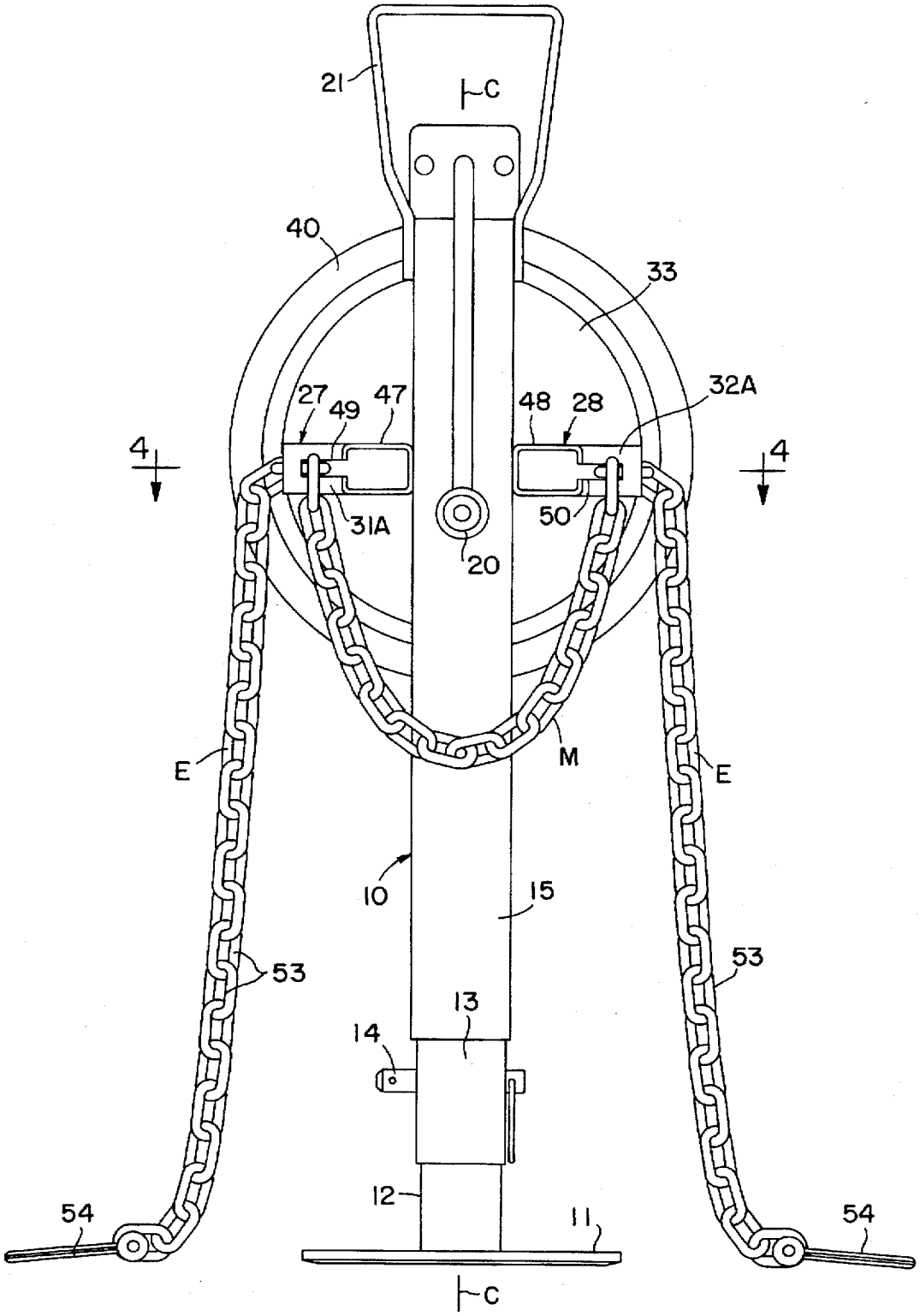
FIG. 2 is an enlarged rear view of the jack apparatus that is generally taken along the line and in the direction of the arrows 2—2 of FIG. 3.
Figure 6:
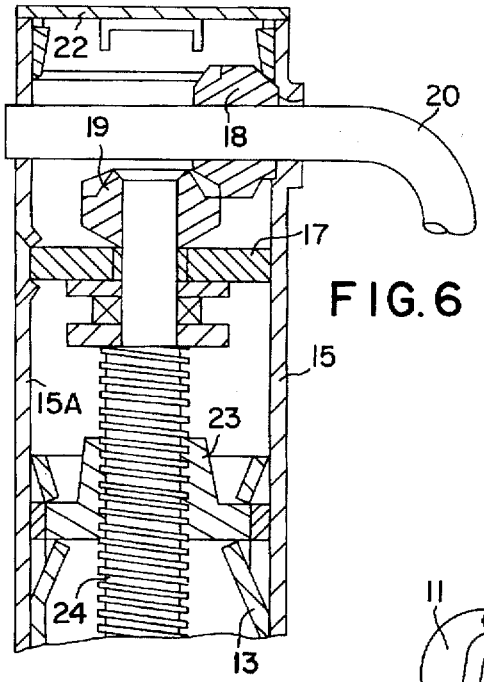
FIG. 6 is a fragmentary vertical cross sectional view of the jack of FIG. 1.
Figure 3:
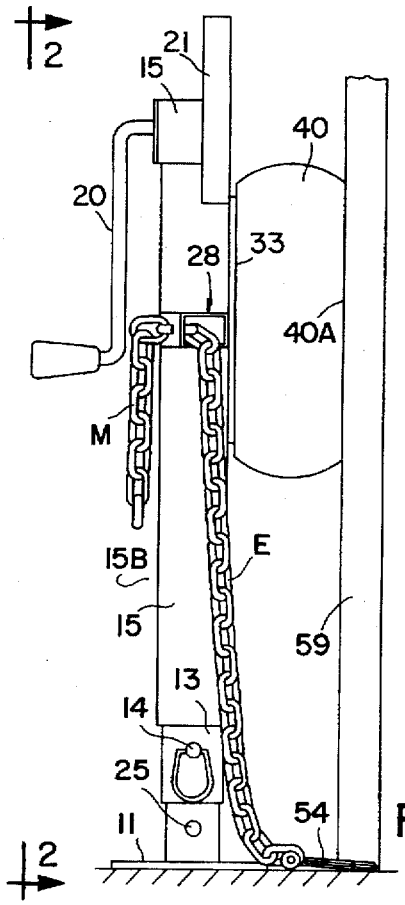
FIG. 3 is a side view of the apparatus of FIG. 2, with it shown in a position for lifting a post after the chains are wrapped around the post and hooked to hold the resilient member in frictional engagement with the post.
Figure 4:
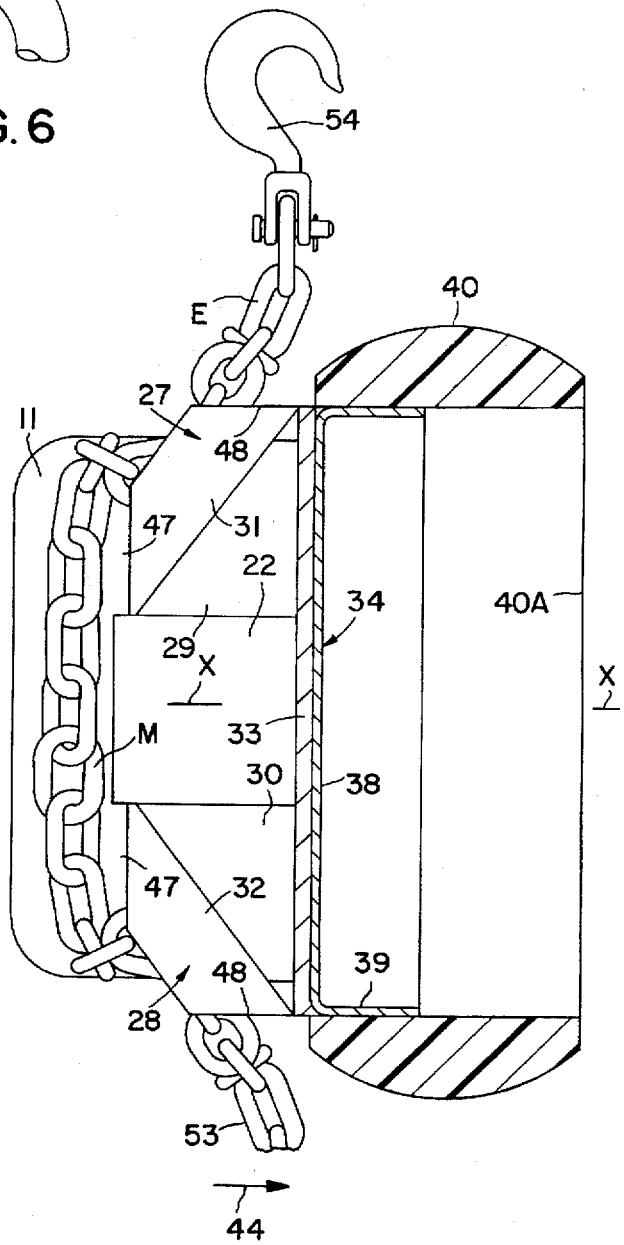
FIG. 4 is in part a top view of the apparatus of FIG. 2 and in part a cross sectional view generally taken along the line and in the direction of the arrows 4—4 of FIG. 2, the jack handle and crank not being shown.

Referring in particular to FIGS. 2 and 4, advantageously the tubular chain mounts 31, 32 diverge away from the tubular housing in a forward direction (arrow 44), for example at an angle of about 80 to 130 degrees, which in part may depend upon the diagonal lengths of the mounts. As shown in FIG. 4, the chain mounts are elongated diagonally with reference to the plane of annular surface 40A. Further, advantageously the rear, generally rectangular terminal edges 47 of the chain mounts are located in a common vertical plane that is parallel to the plane of the tire annular surface 40A while the side, generally rectangular, terminal edges 48 at the remote opposite ends of the chain mounts extend generally perpendicular to said plane. The edges 47 are substantially more closely adjacent to one another than the edges 48.

Advantageously, the chain mounts are rectangular tubes with the rear vertical walls 31A, 32A of the chain mounts 31, 32 respectively having horizontally elongated, chain link mounting, rectangular slots 49, 50 opening through the rear terminal rectangular edges. The height of the slots 49, 50 is slightly greater than the thickness of the links 53 of the chain as may be seen by FIG. 2 but substantially less than the width W of a link. Advantageously, the length L of each of the slots is greater than the width of a link. Each end portion E of the chain has a chain hook 54 removably connected to the respective end link of the chain.

If the jack apparatus is to be used for lifting (elevating), for example one end or side of a storage tank which has legs 57 supporting the tank body 58 off the ground, each end portion E the chain may be wrapped around the respective leg and the hooks hooked to adjacent parts of the chain (the links extended through the reversely curved part of the respective hook 54) with the tire abutting against or closely adjacent to the tank main body when the hooks are hooked to parts of the chain. In the event there is too much, or would be, more than desired slack in the chain prior to jack screw being rotated to elevate the tubular housing, (the length of the end portion E extending between the slots 49, 50 and the hooks being too long), the links extended into the slots 49, 50 are moved transversely toward one another and then the intermediate part M of the chain is moved rearwardly and/or downwardly relative to the arm members to move the appropriate lengths of the chain through the chain mounts. With reference thereto, it is to be noted the cross sectional area of the opening extending through the chain mounts is of a height and width which each are substantially greater than the maximum width of a chain link. Then the appropriate links are moved into the slots 49, 50 to fix the lengths E of the chains extending between the arm member slots and the hooks.

After the hooks are hooked to adjacent parts of the chain, the crank is utilized to rotate the jack screw to elevate the tubular housing and thereby at least part of the tank. As the tank is elevated, it is pulled more tightly against the tire. The tire minimizes the chance of damage to the tank being lifted and frictionally engages the tank to facilitate elevating the tank.

The jack apparatus may be utilized for pulling a post 59 out of the ground. In such a case, with appropriate adjustment of the length of the end portions E, if necessary, the chain end portion(s) may be wrapped around the post and the hook(s) hooked to adjacent part(s) of the chain with the tire abutting against the post. It is noted the width of the post abutting against the tire usually is much less than the inner diameter of the tire, but the post extends to a higher elevation than the tire. Now the jack screw is rotated to elevate the tubular housing and as the tubular housing is elevated, the chain end portion E is tensioned and the friction resistance imparted to the post by elevating the tire increases to facilitate pulling the post out of the ground.

The jack apparatus may be utilized for lifting other objects, for example a vehicle (not shown), by wrapping the appropriate part of the end portions of the chain around the appropriate part of the object, for example the axle (not shown) of a vehicle, and the hooks hooked to adjacent parts of the chain. Thus, end portions of the chain may be wrapped around appropriate parts of the vehicle and the hooks hooked to the end portions or directly to part of the vehicle chassis with the tire abutting against vehicle, for example the bumper (not shown) of the vehicle.

The distance the tire annular surface 40A extends axially further remote from the tubular housing than the rim 39 is sufficiently great that during normal usage the rim would not abut against the object being lifted.

In place of chains, the chain mounts may be modified for having straps (not shown) adjustably attached to end portions of the arm members remote from the tubular housing for having the desired length of straps extend away from the arm members to the terminal ends of the straps, end portions of the straps remote from the modified chain mounts attached or connected to the object to be lifted in a conventional manner and the tire 40 abutting against the object.

Even though the tire 40 has been shown as being solid, it may be of the type having an inflatable inner tube as long as the tire has an annular surface horizontally further remote from the tubular housing than the modified rim on which it is mounted.

What is claimed is:

1. Jack apparatus for vertically elevating an object, the jack apparatus comprising a base, a tubular housing having a top portion, the housing top portion having transversely opposite first and second side portions, a rear portion and a front portion forwardly opposite the rear portion, first means mounted to the base for selectively elevating the tubular housing, a tire mount mounted to the tubular housing front portion, a resilient tire mounted to the tire mount to extend further horizontally more remote from the tubular housing than the tire mount for abutting against the object to be elevated, and second means mounted to the tubular housing and adapted for attachment to the object to be elevated to act in cooperation with the tire to elevate the object.

2. The jack apparatus of claim 1 wherein the tire has a vertical annular surface for abutting against the object to be elevated.

3. The jack apparatus of claim 2 wherein the tire annular surface has a top annular surface portion and a bottom annular surface portion and the second means includes first and second arm members joined to the first and second side portions respectively to extend transversely outwardly of the tubular housing in opposite directions vertically intermediate the tire housing top and bottom portions.

4. The jack apparatus of claim 2 wherein the second means includes a chain mounted to the arm members.

5. Jack apparatus for vertically elevating an object, the jack apparatus comprising a base, a tubular housing having a top portion, the housing top portion having transversely opposite first and second side portions, a rear portion and a front portion forwardly opposite the rear portion, first means mounted to the base for selectively elevating the tubular housing, first and second arm members mounted to the first and second side portions to extend transversely outwardly to the tubular housing in opposite directions for being elevated with the tubular housing, each of the first and second arm members having an end portion transversely remote from the tubular housing, second means having a first portion mounted to the first arm member end portion and an elongated part having an end portion remote from the second means first portion adapted for attachment to the object to be lifted, third means having a first portion mounted to the second arm member end portion and an elongated part having an end portion remote from the third means first portion adapted for attachment to the object to be lifted, resilient means adapted for abutting against the object to be lifted, said resilient means extending a substantial distance above and below the arm members, and a mount for mounting the resilient means to the tubular housing to extend forwardly of the tubular housing and the arm members.

6. The jack apparatus of claim 5 wherein the resilient means has a first portion adapted for abutting against the object to be lifted at a higher elevation than the arm members and a second portion adapted for abutting against the object to be lifted at a lower elevation than the arm members.

7. The jack apparatus of claim 5 wherein the resilient means has a first portion adapted for abutting against the object to be lifted transversely further outwardly of the tubular housing than the first arm member first portion and a second portion adapted for abutting against the object to be lifted transversely further outwardly of the tubular housing than the second arm member first portion.

8. The jack apparatus of claim 5 wherein the tubular housing has a central axis and said resilient means comprises a resilient tire having a central axis substantial perpendicular to the tubular housing central axis.

9. The jack apparatus of claim 8 wherein the mount includes a rim mounting the resilient tire, the tire having an annular surface adapted for abutting against the object to be lifted horizontally more remote from the tubular housing than the rim.

10. The jack apparatus of claim 5 wherein the second and third means housing comprise first and second link chain parts respectively and the first and second arm members comprise first and second chain mounts having chain link mounting slots.

11. The jack apparatus of claim 10 wherein the first and second chain mounts comprise diagonally diverging tubular chain mounts for having the chain parts extended therethrough and have front portions and rear portions more closely adjacent to one another than the chain mount front portions.

12. The jack apparatus of claim 11 wherein the first means includes a jack screw and the second and third means comprise a chain having the chain parts, the first and second means end portions each including a chain hook.

13. The jack apparatus of claim 11 wherein the tubular housing is vertically elongated and has a bottom portion and the arm members are joined to the tubular housing more closely adjacent to the tubular housing top portion than the tubular housing bottom portion.

* * * * *